United States Patent [19]

Costa

[11] Patent Number: 4,806,085

[45] Date of Patent: Feb. 21, 1989

[54] ROTARY HYDRAULIC PISTON MOTOR WITH FLUID PATH IN PISTONS FOR INLET PRESSURE

[76] Inventor: Irenio Costa, 220 SW. 56th Ter., Margate, Fla. 33063

[21] Appl. No.: 38,954

[22] Filed: Apr. 16, 1987

[51] Int. Cl.[4] ..... F03C 2/22

[52] U.S. Cl. ..... 418/184; 418/212; 418/267

[58] Field of Search ..... 418/267, 268, 269, 212, 418/239, 184, 188

[56] References Cited

U.S. PATENT DOCUMENTS

| | | | |
|---|---|---|---|
| Re. 27,241 | 12/1971 | Pace et al. | 418/268 |
| 141,710 | 8/1873 | Gibson | 418/184 |
| 868,841 | 10/1907 | Calkins | 418/184 |
| 2,174,664 | 10/1939 | Korany | 418/268 |
| 2,435,279 | 2/1948 | Hubacker | 418/268 |
| 2,475,224 | 7/1949 | Deitrickson | 418/184 |
| 2,514,521 | 7/1950 | Shaff | 418/267 X |
| 2,910,052 | 10/1959 | Osborn | 418/212 |
| 4,604,041 | 8/1986 | Hertell et al. | 418/268 X |

*Primary Examiner*—John J. Vrablik

*Attorney, Agent, or Firm*—Harry W. Barron

[57] ABSTRACT

A reversible hydraulic motor has a forward and a reverse drive section, each separated by a separating plate. Each section has an outer ring, end plate and inner rotor forming a chamber therebetween. Each rotor has a pair of radial slots, separated by 180°, and a piston moveable in each slot. An extension form the outer ring to the rotor divides the chamber and moves the pistons inward into the rotor slots at the end of each revolution. Hydraulic fluid is selectively applied, under pressure, to the desired direction section to the interior space between the rotor slot and the piston during the 180° after the rotor rotates past the extension. Each piston has a fluid path therethrough to allow the provided hydraulic fluid to exit the piston interior space into the chamber in a direction opposite to the desired direction of rotation. This exiting fluid builds up pressure in the chamber and rotates the piston and rotor. A fluid return path is provided in the second ½° portion of each revolution to allow the fluid added during the initial 180° of rotation to be returned to the hydraulic pumping system. The return path includes a channel to allow the fluid between the piston and slot to also be returned as the piston is moved inward by the extension. Additional selective return means are associated with the nonselected section to allow a return path for the fluid therein.

35 Claims, 3 Drawing Sheets

Fig. 5A.
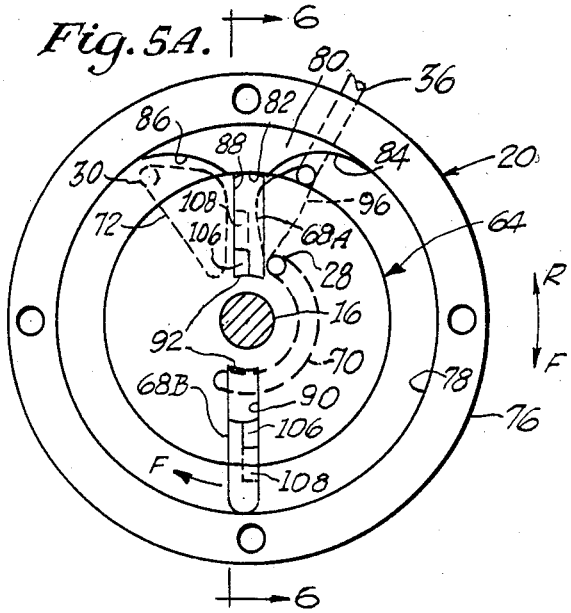
Fig. 5B.
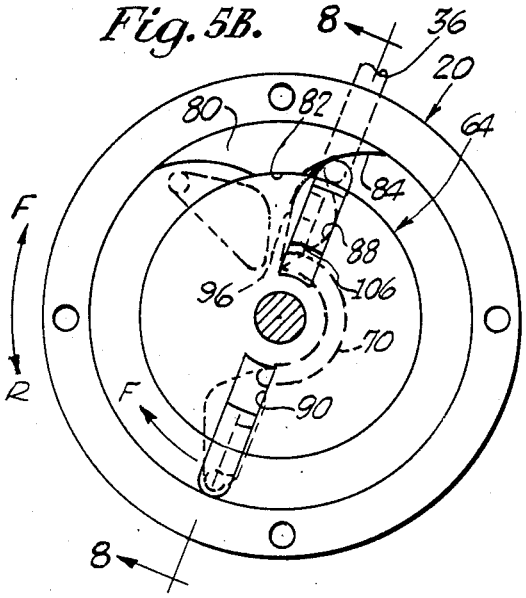
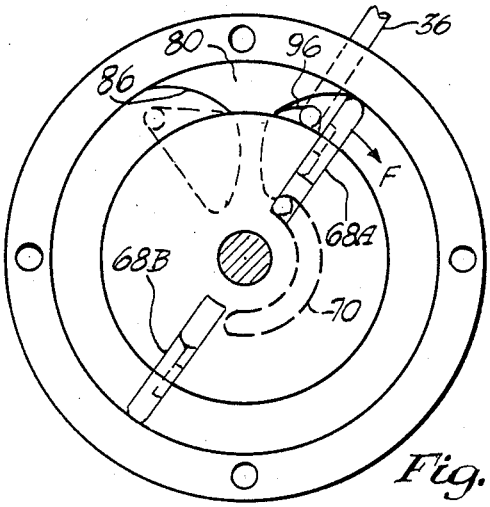
Fig. 5C.
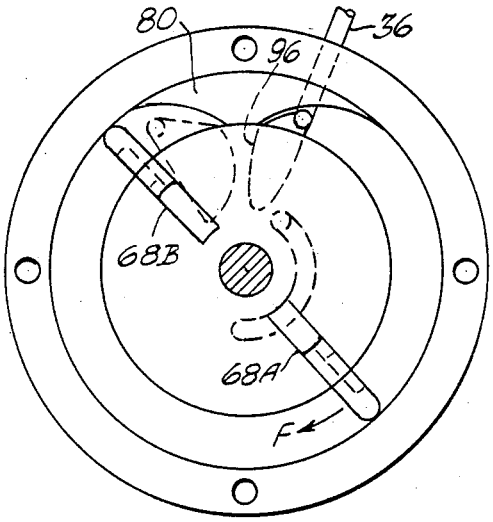
Fig. 5D.
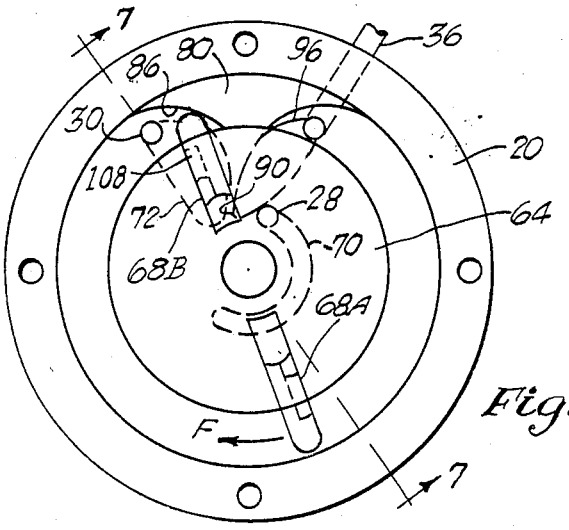
Fig. 5E.

ROTARY HYDRAULIC PISTON MOTOR WITH FLUID PATH IN PISTONS FOR INLET PRESSURE

This invention relates to a hydraulic motor and more specifically to such a motor which is reversible and which uses a minimum number of different component parts.

Hydraulic motors have been known for many years and have many uses, particularly where a large amount of power or torque is required. In the past, hydraulic motors have been rather complex structures with many different moving and interacting parts. Each of the parts is susceptible to wear or breakage, thereby rendering the motor unreliable. Further, the prior art hydraulic motors typically could only generated additional torque or power by increasing the pressure of the hydraulic fluid provided to the motor. Thus, a practical limit on the torque or power obtainable was always present and depended upon the size of the pump available.

The above problems are compounded when one desired to build a reversible hydraulic motor. Such a motor requires two sets of functioning drive elements in order to achieve the bidirectional movement. Where possible, it is desirable to use either the same element in both operations or to use identically configured parts in both sets in order to reduce costs.

Examples of prior art U.S. patents showing hydraulic mechanisms with dual operating chambers are as follows: U.S. Pat. Nos. 2,869,516; 3,426,694; 3,430,574; 3,672,168; 3,740,954; 4,451,241; 4,508,494; 4,551,079.

In accordance with one aspect of this invention, there is provided a hydraulic motor comprising a rotating member having a shaft perpendicularly affixed to the rotational center thereof and a pair of slots radially positioned therein. The motor further includes a casing around the rotating member through which the shaft extends forming a rotational closed chamber. Further, there is provided a pair of pistons, each radially movable in a different one of the slots and each piston having a flow path from the interior side of the slot in which it moves towards the chamber. Each piston flow path has a length such that fluid can flow when the piston is extended to the casing and fluid is blocked from flowing when the piston is directed into the slot. In addition, the motor includes piston directing means positioned in the chamber and shaped to direct the pistons into the slots as the pistons rotate past the directing means and fluid providing means for providing fluid into the interior of one of the slots during the one half revolution following the piston being rotated past the directing means and for removing the provided fluid after the one half revolution.

One preferred embodiment of the subject invention is hereafter described, with specific reference being made to the following Figures, in which:

FIGS. 5A through 5E show schematically the operation of the hydraulic motor shown in FIG. 1;

Figure 1:
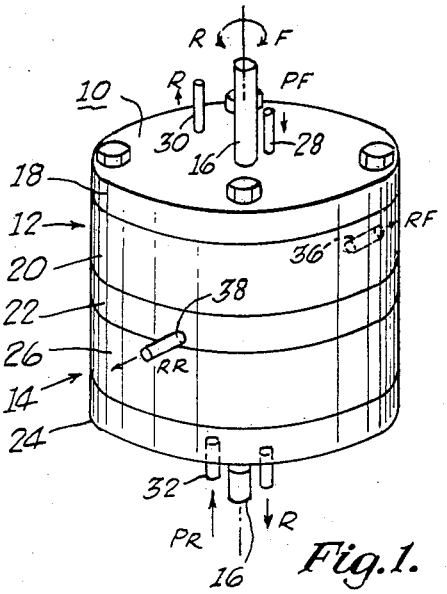
FIG. 1 shows a prospective view of a reversible hydraulic motor of the subject invention.

Referring now to FIG. 1, reversible hydraulic motor 10 of the subject invention will now be explained. Motor 10 includes a forward section 12 and a reverse section 14 for respectively causing shaft 16 to rotate in either the forward (F) direction or the reverse (R) direction, as indicated by the direction arrow above shaft 16. Forward section 12 includes a forward end plate 18 and a forward ring 20, both affixed to a separator plate 22. Separator plate 22 separates the forward section 12 from the reverse section 14 and is a part of both. Reverse section 14 also includes a reverse end plate 24 and a reverse ring 26.

Affixed to the outside of forward end plate 18 is a selectable forward pressure inlet coupling 28 and a forward reverse outlet coupling 30. Affixed to the outer side of return end plate 24 is a selectable reverse pressure inlet coupling 32 and a reverse return outlet coupling 34. Affixed to separator plate 22 is a selectable forward return outlet 36 and a selectable reverse return outlet 38. Forward return outlet 30 and reverse return outlet 34 are always maintained open during either the forward or the reverse mode of operation. Motor 10 operates in the forward direction when hydraulic fluid under pressure is applied to forward pressure inlet 28 and selectable reverse return outlet 38 is opened to be a return path along with forward return outlet 30. Motor 10 operates in the reverse direction when hydraulic fluid under pressure is applied to reverse pressure inlet 32 and selectable forward return outlet 36 is opened to be a return path along, with reverse return outlet 34.

Figure 2:
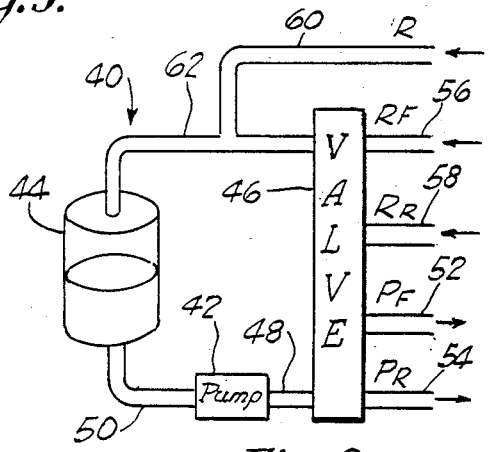
FIG. 2 shows the hydraulic pump and associated piping and valve to be coupled to operate the motor shown in FIG. 1.

Referring now to FIG. 2, fluid control system 40 is shown, and includes a pump 42, a reservoir 44 and a valve 46. Hydraulic fluid under pressure is applied to one side 48 of pump 42, which, in turn, is coupled to the pressure side of valve 46. The other side 50 of pump 42 is coupled to receive hydraulic fluid from reservoir 44. The pressure side of valve 46, in turn, applies the hydraulic fluid under pressure to one side of a selected one of the forward pressure line 52 or the reverse pressure line 54. The other side of lines 52 and 54 are respectively coupled to the selectable forward pressure inlet 28 and the selectable reverse pressure inlet 32, shown in FIG. 1. The return side of valve 46 has one side of the forward return line 56 and one side of the reverse return line 58 coupled thereto. The other sides of lines 56 and 58 are respectively coupled to the selectable forward return outlet 36 and the selectable reverse return outlet 38 shown, in FIG. 1.

Valve 46 is operable to select a pair of lines for either forward operation or reverse operation. If forward operation is desired, valve 46 is engaged so that forward pressure line 52 and reverse return line 58 are selected to be opened, such that fluid under pressure from pump 42 is applied to forward pressure line 52 and returning fluid from outlet 38 can pass through reverse return line 58. Lines 54 and 56 are closed so that no hydraulic fluid moves therethrough during forward operation of motor 10. If reverse operation is desired, valve 46 is engaged so that reverse pressure line 54 and forward return line 56 are selected to be opened, such that fluid under pressure from pump 42 is applied to reverse pressure line 54 and returning fluid from outlet 36 passes through forward return line 56. Lines 52 and 58 are closed so that no hydraulic fluid moves therethrough during reverse operation of motor 10.

Fluid control system 40 also includes open return line 60, which is coupled to both of forward return outlet 30 and reverse return outlet 34. Line 60 is coupled to the return side outlet side of valve 46 so that the returning fluid from both line 60 and the selected on of lines 56 and 58 are combined and supplied through line 62 to recharge reservoir 44. Under normal operation, the amount of fluid taken from reservoir 44 by pump 42 will equal the amount returned by line 62. Reservoir 44 is used however to purge any air or other foreign matter which may inadvertently have become mixed with the hydraulic fluid. In practice, pump 42 and reservoir 44 may be combined into a single commercial product.

Figure 3:
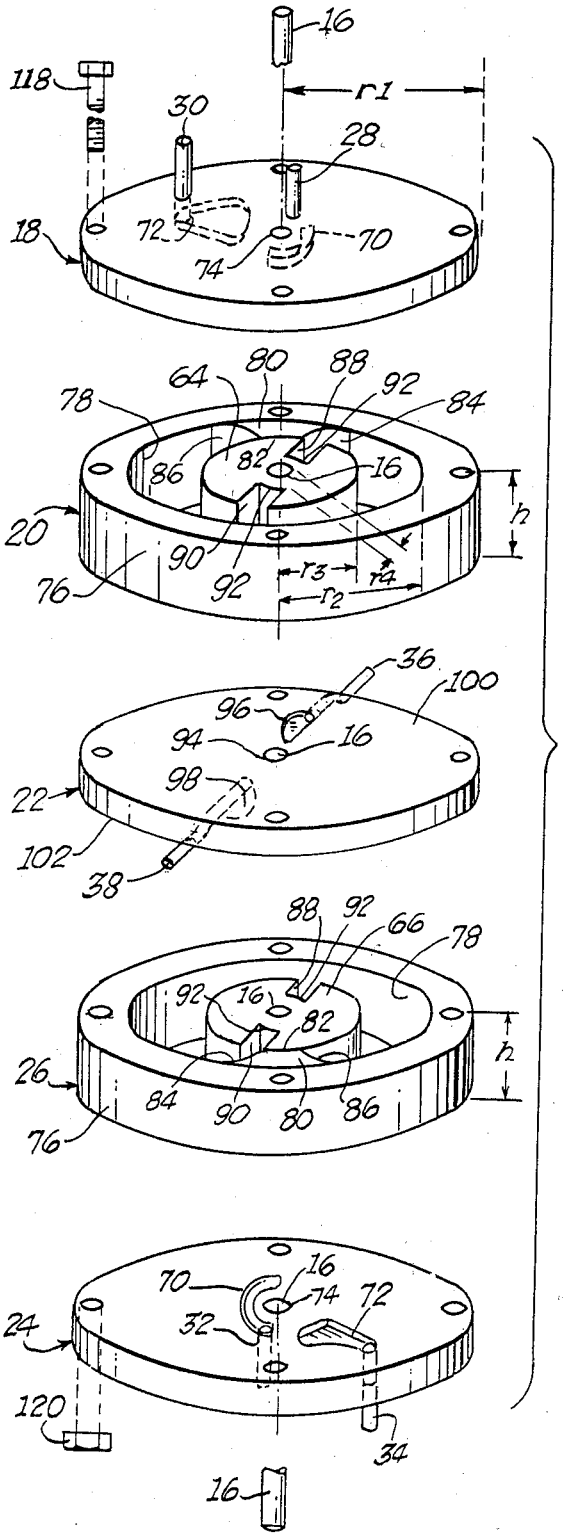
FIG. 3 shows an exploded view of the major parts, except the pistons, of the hydraulic motor shown in FIG. 1.
Figure 4:
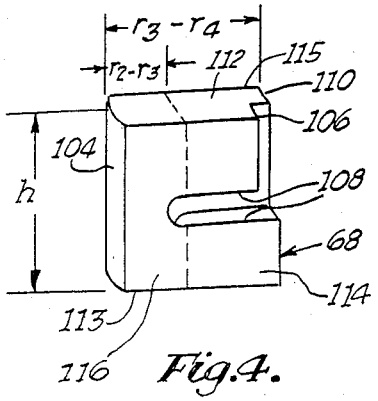
FIG. 4 shows a prospective view of the piston used in the hydraulic motor shown in FIG. 1.

Referring now to FIGS. 3 and 4, an exploded view of the various parts of the reversible hydraulic motor 10 is shown. Like components are given like numeral designations. From FIG. 3, it should be observed that the forward end plate 18 and the reverse end plate 24 are identical in construction and that the forward ring 20 and reverse ring 26 are also identical in construction. Only three other moving parts are shown in Figures 3 and 4 and these are the forward rotating member, or rotor 64, the reverse rotating member, or rotor 66 and the piston 68, of which four are used but only one shown in FIG. 4. The two rotors 64 and 66 again are identical in construction and the four pistons 68 are identical in construction. Thus, there are only six different component parts used to construct motor 10 and these are the end plates 18 and 24, the rings 20 and 26, the separator plate 22, the rotors 64 and 66, the pistons 68 and the shaft 16. By designing motor 10 to have only six different component parts, considerable savings in design and fabrication of component parts is realized in mass producing motor 10.

End plates 18 and 24 are each constructed of a hard metal material, such as stainless steel, and are circular in shape with a given radius r1. Both end plates 18 and 24 have a pair of cut-out, or channel, sections 70 and 72 in the side thereof facing rings 20 and 26. Channel 70 is a 180° arc, concentric to shaft 16, and positioned in a certain location of plates 18 and 24 to be described hereafter with respect to FIGS. 5A through 5E and FIG. 6. Channel 72 is generally similar in shape to the letter D and again, its exact functional size and location will be described hereafter with respect to FIGS. 5A through 5E and FIG. 6. Both channels 70 and 72 may be cut to approximately one half of the depth of plates 18 and 24.

Each channel 70 (one being in each end plate 18 and 24) is in fluid communication with one of the pressure inlets 28 and 32 through a hole aligned therewith entirely through plate 18 or 24. The exact location of inlets 28 and 32 is not critical so long as a fluid flow path exists from the hydraulic fluid applied to inlets 28 and 32 to the channels 70. Similarly, each channel 72 (one being in each end plate 18 and 24) is in fluid communication, such as by a hole through the end plate 18 or 24, with the associated one of outlets 30 and 34 Preferably outlets 30 and 34 are positioned above the chamber between rotors 64 and 66 and rings 20 and 26 respectively. Shaft 16 is provided through a hole 74 at the radial center of plates 18 and 24, which hole 74 is sized to allow shaft 16 to rotate freely, but without appreciable wobble.

Rings 20 and 26 have an outer surface 76 of radius r1 from the center of shaft 16, an inner surface 78 of a radius r2 from the center of shaft 16 (r2 being smaller than r1) and a height h. Extending from one part of the inner surface 78 of rings 20 and 26 is a piston directing extension member 80. Extension 80 has an interior concave circular surface 82 of a radius r3, less than radius r2, from the center of shaft 16, and smooth curving sides 84 and 86 from ring inner surface 78 to concave surface 82, such that the transition from surface 78 to or from sides 84 and 86 is as smooth as possible.

Rotors 64 and 66 are generally circular with a radius r3, from the center of shaft 16 and a height h. A pair of radial slots 88 and 90 are formed in rotors 64 and 66 having an interior surface 92 of a radius r4, less than r3. The side walls of slots 88 and 90 are parallel to the radial center thereof and extend the entire depth of rotors 64 and 66. Each of the rotors 64 and 66 are affixed to the shaft 16 by a slot or pin connection (not shown) in a known manner. Thus, as rotors 64 and 66 are rotated by hydraulic fluid flowing through pistons 68 moving in slots 88 and 90, as hereafter described, shaft 16 is correspondingly rotated.

Separator plate 22 is generally a flat disk shape of radius r1 having a hole 94 through which shaft 16 rotates. Forward and reverse selective return channel cutouts 96 and 98, generally in the shape of the letter D, are made on forward side 100 and reverse side 102 respectively of separator plate 22. Channel 96 is in fluid communication with return outlet 36 and channel 98 is in fluid communication with return outlet 38. Such fluid communication may be achieved by a hole radially inward from outlets 36 and 38 to channels 96 and 98 respectively.

Referring to FIG. 4, piston 68 is shown in enlarged prospective. Piston 68 is sized to slide within each of the slots 88 and 90. Piston 68 has a height h, the same as the height h of rotors 64 and 66, and a width equal to the depth of slots 88 and 90, that is r3-r4. Piston 68, thus, can slide radially inward to be wholly within slots 88 or 90, or can slide radially outward to be positioned with exterior side 104 thereof against inner surface 78 of rings 20 and 26, while still being partially within slots 88 or 90. Exterior side 104 may be shaped with a radius r3 so that a smooth surface with rotor 64 is formed when a piston 68 is wholly within a slot 88 or 90. In order for slots 88 or 90 to provide proper guidance and support for pistons 68, the slot 88 or 90 depth, the distance r3-r4 should be more than twice the chamber distance r2-r3. In addition, the chamber distance r2-r3 between rotors 64 or 66 and the inner surface 78 of rings 20 and 26, as well as the height h, should be maintained relatively small to minimize the amount of hydraulic fluid used and to maintain a greater pressure for a given volume of hydraulic fluid flowing from pump 42. These minimized distances increase the obtainable speed of motor 10.

Pistons 68 also includes a vertical cut 106 and a horizontal slot 108. Cut 106 is on the interior side 110 of piston 68, is approximately one half the depth of piston 68 and extends from the top 112 of piston 68 down about one half of height h. Slot 108 is of the same depth as cut 106 and extends in side 114 of piston 68 from cut 106 towards exterior side 104. Slot 108 is designed to extend into the area 116, which is in the space between inner surface 78 of rings 20 and 26 and rotors 64 or 66 when piston 68 is fully extended from slots 88 or 90.

Thus, a fluid path exists from the piston interior space behind side 110 to the chamber space between inner surface 78 of rings 20 and 26 and rotors 64 or 66 when piston 68 is extended.

Each of the component parts 18, 20, 22, 24, 26, 64, 68 and 80 must be fabricated with close tolerances so that when assembled by four bolts 118 and associated nuts 120 (only one of each being shown), the following fluid seals are formed. First, the top and bottom of rotors 64 and 66 must form a fluid seal with plates 18, 22 and 24 while still being able to freely rotate. Further, the top 112 and bottom 113 of pistons 68 must form rotating fluid seals with plates 18, 22 and 24 and the exterior surface 104 of piston 68 must form a fluid seal while rotating around inner surface 78 of rings 20 and 26. By proper selection of materials for the component parts, such as machined smooth stainless steel or smooth hard plastics materials, such as Teflon brand plastic, the appropriate rotating freedom and fluid seals can be attained. For example, the rings 20 and 26 and extension 80 may be stainless steel and the plates 18, 22 and 24, the rotors 64 and 66 and the pistons 68 may be hard and smooth plastic material.

Referring now to FIGS. 5A through 5E and to FIGS. 6, 7 and 8, the operation of motor 10 will be explained. First, beginning with FIG. 5A, and FIG. 6, rotor 64 in seen in the home position, or with the radial center line of slot 88 at 0° and the radial center line of slot 90 at 180°. In the home position, piston 68A is in the retracted position in slot 88 and piston 68B is in the fully extended position from slot 90. It will be appreciated after the discussion of the operation of motor 10 how pistons 68A and 68B attained the positions shown in FIGS. 5A and 6. In the home position of FIG. 5A, hydraulic fluid flows in to inlet 28, through semicircular channel 70 and into the interior space between the interior side 110 of piston 68B and the interior surface 92 of slot 90. From this interior space, the fluid flows through horizontal slot 108 of piston 68B and exits into the pressure chamber space formed between the inner surface 78 of ring 20, the outer surface of rotor 64, surface 114 of piston 68B and side 84 of extension 80. The exiting hydraulic fluid increases the pressure in the pressure chamber space and, thereby, forces the extended piston 68B from slot 90 in a clockwise, or forward direction. This, in turn, causes rotor 64, and shaft 16 affixed thereto, to rotate.

Referring now to FIG. 5B, 5C and 5D, as rotor 64 rotates in a clockwise direction, piston 68A in slot 88 rotates away from being in contact with surface 82 of extension 80 and, at the same time, rotates over one end of channel 70. At the same time, piston 68B in slot 90 begins to rotate beyond the other end of channel 70. This causes hydraulic fluid to enter the space existing as a result of vertical cut 106 in piston 68A, thereby increasing the pressure in that space. This increase in fluid pressure forces piston 68A in slot 88 in a radially outward direction against side 84 of extension 80. At the point fluid ceases flowing into slot 90, piston 68A will have been extended to the point such that horizontal slot 108 passes the outer side of rotor 64, thereby providing a fluid path through piston 68A in slot 88. Thus, fluid pressure begins to build up in a new pressure chamber space now formed between the rotor 64, surface 78, side 114 of piston 68A in slot 88 and side 84 of extension 80. This pressure causes piston 68A, now fully extended from slot 88, to rotate rotor 64 in a clockwise, or forward, direction. This continues as seen in the subsequent positions of the components, as shown in FIGS. 5C and 5D. Thus, channel 70 is positioned over the 180° path traveled by cut 106 of pistons 68 from a point a piston 68 rotates past surface 82 of extension 80.

Figure 6:
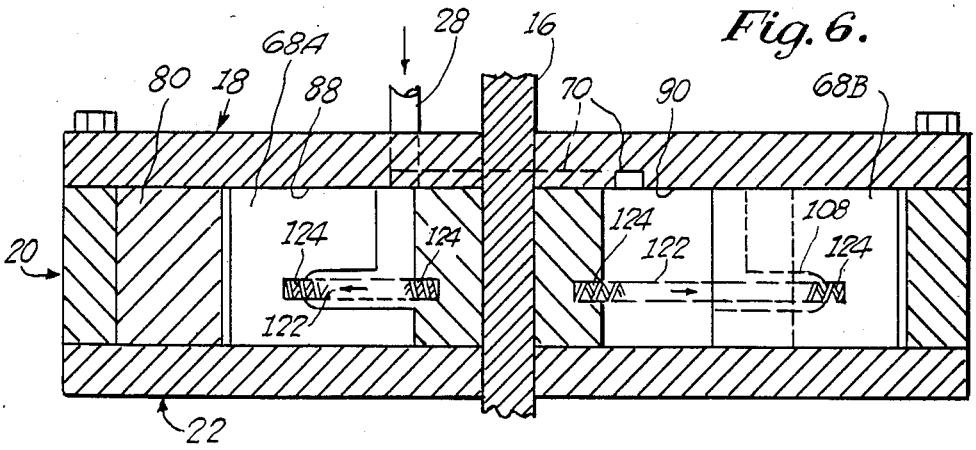
FIG. 6 shows a cross sectional view across lines 6—6 of FIG. 5A.

Referring to FIG. 6, rather than depending upon the hydraulic pressure in vertical cut 106 of piston 68A to force piston 68A radially outward as piston 68A leaves contact against surface 82, a pair of compressed springs 124 may be inserted in spring holding holes 126 to force piston 68A outward.

While the extended piston 68A from slot 88 is forced in the forward rotational direction, piston 68B also moves in the forward rotational direction as a result of the movement of rotor 64. This increases the pressure in the return chamber space forward of side 115 of piston 68B and between surface 78 of ring 20, rotor 64 and surface 86 of extension 80. The pressure in the return chamber space is relieved by the return path 60 coupled to outlet 30 into which the fluid forward of piston 68B flows, whereby low pressure is maintained in the return chamber forward of piston 68B.

Figure 7:
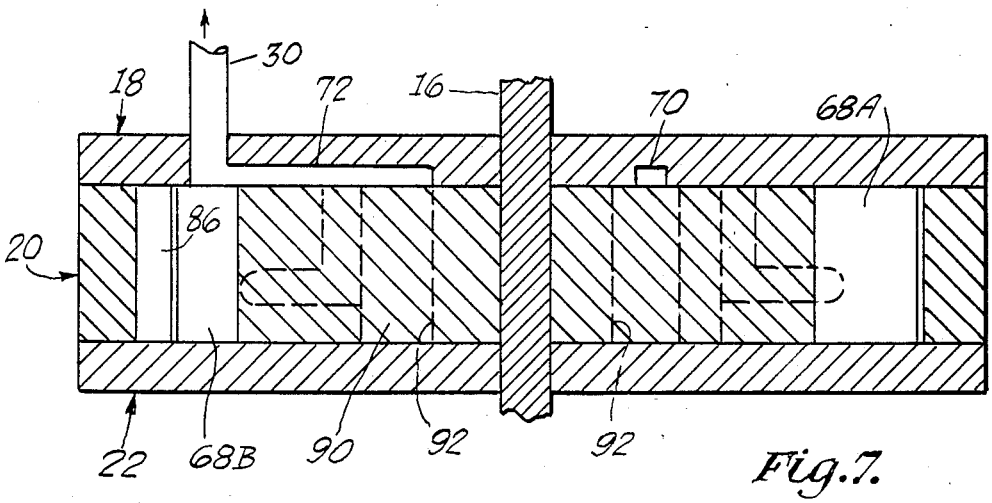
FIG. 7 shows a cross sectional view across lines 7—7 of FIG. 5E.
Figure 8:
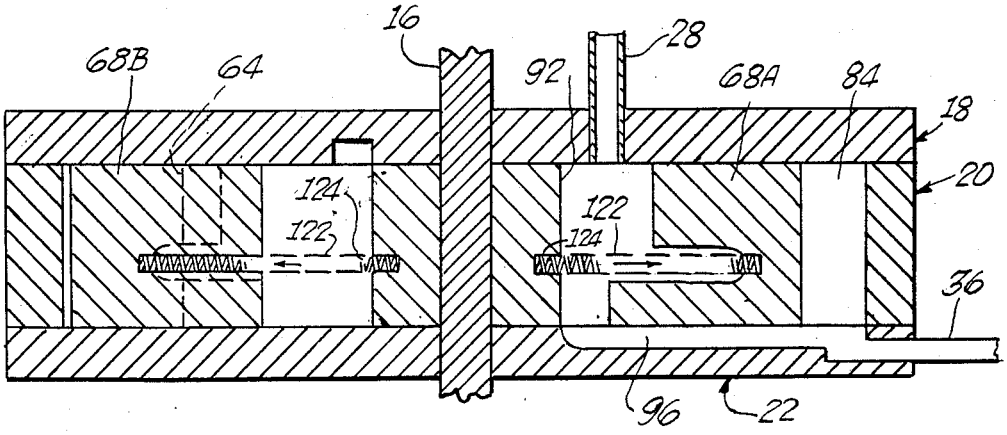
FIG. 8 shows a cross sectional view across lines 8—8 of FIG. 5B.

Referring to FIG. 5E and FIG. 7, at some point, piston 68B rotates beyond the hole from outlet 30. When this occurs, pressure can still build up in the ring 20 to rotor 64 chamber space forward of piston 68B and before side 86 of extension 80. In addition, as piston 68B is forced back into slot 90, pressure builds up in the interior space therein. To relieve the buildup of pressure in the interior of slot 90, channel 72, formed in forward end plate 18, extents between the interior side of slot 90 as it approaches the rotational position where piston 68B is fully inserted into slot 90 by surface 86 of extension 80. Channel 72 also extents above the junction of surface 86 with rotor 64 to relieve the pressure in the ring 20 to rotor 64 space. Thus, a free return path always exists during the rotation of a piston 68 from the 180° position to the 360°, or 0° position.

The above described movement of rotor 64 continues in the same manner as just described with piston 68B thereafter driving rotor 64 while moving from the 0° position to the 180° position, at which time the home position shown in FIG. 5A and FIG. 6 is again reached.

It should be noted that the rotational speed of shaft 16 of motor 10 depends upon the pressure created by the fluid flowing from fluid control system 40 in FIG. 2. However, the power, or torque delivered by shaft 16, depends upon the distances of radius r2. If the radius r2 is increased in size, a greater amount of power can be delivered by shaft 16. It is desirable to maintain the size difference between radii r2 and r3 relatively small so that a minimum amount of hydraulic fluid is used. In addition, the volume of the pressure chamber is kept to a minimum, and hence, the pressure therein is maintained higher for a given amount of fluid flowing from pump 42. This, in turn, allows greater speed of shaft 16. By making radius r2 large, a large amount of power can be delivered by motor 10. Thus, it can be used as a winch motor to lift heavy objects.

As previously mentioned, motor 10 is designed to be reversible. This occurs by changing the fluid pressure to inlet 32 and changing the selectable fluid return path to return 36. When fluid pressure is applied to inlet 32, the reverse section 14 of motor 10 is operable. The pistons are now upside down from those in the forward section 12 and hence the fluid flow path through slot 108 results in rotation in the opposite direction. The operation of reverse section 14 is exactly as explained above and need not be repeated.

During the first revolution of reverse rotation, fluid pressure must be relieved from the forward section 12. Referring to FIGS. 5B and 8, the function of selectable return outlet 36 and channel 96 is to relieve pressure when reverse operation is selected. As rotor 64 moves in the counter clockwise, or reverse, direction, pressure builds up in the space between piston 68 and side 84 of extension 80. This pressure is relieved by selecting return 36 to be open during reverse operation. Channel 96 extends to the junction of side 84 and rotor 64 and to the position in which the back of slot 88 will be at the time piston 68A is fully retracted by side 84 of extension 80. In this manner, the pressure is relieved by a selectively opened return line. It is not desirable to have return line 36 or channel 96 operating during the forward rotation since pressure would never build up behind the rotating pistons to maintain the rotation. When going from the reverse direction to the forward direction, channel 98 functions to relieve pressure in reverse section 14 the same way channel 96 relieved pressure in forward section 12.

What is claimed is:

1. A hydraulic motor comprising:

an outer casing;

a rotating member positioned within said casing and having a pair of separated slots therein, a chamber being formed between said rotating member and said casing;

a shaft attached to the rotational center of said rotating member and extending from said casing;

a pair of pistons independently movable radially in said slots, said pistons having a fluid path formed therein from the side of said piston facing said shaft towards said chamber, said fluid path having a length such that fluid can flow through said fluid path when said piston is extended to contact said casing and fluid is prevented from flowing through said fluid path when said piston is directed towards said shaft;

means within said chamber to direct said pistons to move towards said shaft at least once each revolution;

means for providing hydraulic fluid under pressure on the shaft facing side of said pistons; and means for providing a free return path for said hydraulic fluid to said means for providing, said return path including a return outlet from said chamber and a fluid path bridging said outlet and the interior space between said piston and said rotating member when said piston is directed towards said shaft.

2. The invention according to claim 1 wherein said fluid path in each piston extends along the side of said piston and is further formed by the wall of said slot in which said piston moves.

3. The invention according to claim 1 wherein each of said pistons includes a first slot therein along the interior end thereof directed perpendicular to the plane of rotation of said rotating member and a second slot therein extending parallel to said plane of rotation and having a length of less than the length of said piston.

4. The invention according to claim 1 wherein said casing includes a ring member surrounding said rotating member and a pair of plates respectively affixed to said ring member above and below said rotating member.

5. The invention according to claim 1:

wherein said casing includes a ring member and a cover member further defining, together with said rotating member, said chamber;

wherein said return path includes a return coupling from said cover member; and wherein said bridging fluid path is in said cover member.

6. The invention according to claim 5 wherein said bridging fluid path is a cutout in said cover member.

7. The invention according to claim 6 wherein said fluid path in each piston extends along the side of said piston and is further formed by the wall of said slot in which said piston moves.

8. The invention according to claim 7 wherein each of said pistons includes a first slot therein along to the interior end thereof directed perpendicular to the plain of rotation of said rotating member and a second slot therein extending parallel to said plane of rotation and having a length of less than the length of said piston.

9. The invention according to claim 8 wherein said means to direct includes a smooth curved surface from said casing to said rotating member and forms a fluid seal between said casing and said rotating member.

10. The invention according to claim 5:

wherein said means for providing includes a coupling inlet attached to said cover member; and wherein said cover member includes a pressure flow path cut therein positioned above the path of said interior space from said means to direct and extending along an arc of at least 180°, said pressure flow path being sealed from said chamber other than through the piston thereunder, said coupling inlet being in fluid communication with said pressure flow path.

11. The invention according to claim 1:

wherein said casing includes a ring member and a cover member further defining, together with said rotating member, said chamber, said cover member including a coupling inlet attached thereto; and wherein said cover member includes a pressure flow path cut therein positioned above the path of said space from said means to direct and extending along an arc of at least 180°, said pressure flow path being sealed from said chamber other than through the piston thereunder, said coupling inlet being in fluid communication with said pressure flow path.

12. The invention according to claim 1 wherein said means to direct includes a smooth curved surface from said casing to said rotating member and forms a fluid seal between said casing and said rotating member.

13. The invention according to claim 1 wherein said pistons each include spring means positioned between said pistons and said rotating member and biased to move said pistons away from said rotational center.

14. A hydraulic motor comprising:

a rotating member having a shaft perpendicularly affixed to the rotational center thereof and a pair of separated slots radially positioned therein;

a casing around said rotating member, through which said shaft extends, forming a rotational closed chamber;

a pair of pistons, each independently radially movable in a different one of said slots, each piston having a flow path from the interior side of said slot in which it moves towards said chamber, each piston flow path having a length such that fluid can flow when said piston is extended to said casing and fluid is blocked from flowing when said piston is directed into said slot;

piston directing means positioned in said closed chamber and shaped to direct said pistons into said slots as said pistons rotate past said directing means;

fluid providing means for providing fluid into the interior of one of said slots during a portion of one revolution following said piston being rotated past said directing means; and means for removing said provided fluid after said portion of one revolution, including a free return outlet positioned in said chamber and a fluid path in fluid communication with said return outlet, said fluid path being aligned with that area formed between the interior side of a piston and the back of a slot during the time a piston is directed into a slot, said fluid path further being aligned with said chamber from said outlet to the end of said directing means opposite to the direction of rotation of said rotating member.

15. The invention according to claim 14:

wherein said rotating member is circular with a given radius; and wherein said casing includes a ring structure having an inner radius greater than said given radius and a top and bottom plate affixed to said ring structure to form said chamber between said top and bottom plates, said rotating member and inner surface, said piston directing means extending from said ring structure inner surface to said rotating member and being in sealed contact with said top and bottom plates and said rotating member.

16. The invention according to claim 15 wherein said piston directing means includes a smooth curved surface on the side thereof opposite to the direction of rotation of said rotating member.

17. The invention according to claim 15 wherein said pistons each include spring means positioned between said interior side of said piston and said rotating member and biased away from said rotational center.

18. The invention according to claim 15 wherein one of said top and bottom plates includes a channel formed in the side thereof facing said rotating member and extending from the side in the direction of rotation of said piston directing means over the path followed by the space between the back of said slot and the interior surface of said piston, said fluid providing means being coupled in fluid communication with said channel.

19. The invention according to claim 18 wherein one of said top and bottom plates include said fluid path of said means for removing.

20. The invention according to claim 15 wherein one of said top and bottom plates include said fluid path of said means for removing.

21. The invention according to claim 15 wherein said pair of slots in said rotating member are positioned 180° from one another.

22. A reversible hydraulic motor for rotating a shaft in a desired rotational direction comprising:

forward and reverse rotating members, each having said shaft perpendicularly affixed to the rotational center thereof and each having a pair of separated slots radially formed therein, each slot having an interior closed side towards the radial center of said rotating member with which it is formed;

a separating plate between said forward and reverse rotating members through which said shaft extends;

a casing around said forward and reverse rotating members, through which said shaft extends, said casing and separating plate forming respective forward and reverse rotational closed chambers, each such chamber being associated with a corresponding one of said forward and reverse rotating member;

a forward pair of pistons, each independently radially movable in a different one of said slots of said forward rotating member, each forward piston having a flow path from said interior side of said slot in which it moves towards said forward chamber, each piston flow path having a length such that fluid can flow in the same forward radial direction when said piston is extended to said casing and fluid is blocked from flowing when said piston is directed into said slot;

a reverse pair of pistons, each independently radially movable in a different one of said slots of said reverse rotating member, each reverse piston having a flow path from said interior side of said slot in which it moves towards said reverse chamber, each piston flow path having a length such that fluid can flow in the same reverse radial direction when said piston is extended to said casing and fluid is blocked from flowing when said piston is directed into said slot;

forward piston directing means, associated with said forward rotating member, positioned in said forward closed chamber and shaped to direct said forward pair of pistons into said slots of said forward rotating member as said forward pair of pistons rotate past said forward piston directing means; and reverse piston directing means, associated with reverse rotating member, positioned in said reverse closed chamber and shaped to direct said reverse pair of pistons into said slots of said reverse rotating member as said reverse pair of pistons rotate past said reverse piston directing means;

fluid providing means for providing fluid into said interior side of one slot at a time of a selected one of said rotating members during a portion of one revolution, following said piston in said one slot being rotated past said directing means associated therewith; and means for removing said provided fluid after said portion of one revolution, including a free return outlet positioned in said chamber and a fluid path in fluid communication with said return outlet, said fluid path being aligned with that area formed between the interior side of a piston and the back of a slot during the time a piston is directed into a slot, said fluid path further being aligned with said chamber from said outlet to the end of said directing means opposite to the direction of rotation of said rotating member said selected one of said pair of rotating members being determined based upon said desired direction of rotation of said shaft.

23. The invention according to claim 22:

wherein said casing includes a forward casing and a reverse casing;

wherein said forward rotating member, said forward pair of pistons and said forward piston directing means constitute a forward hydraulic motor formed within a structure surrounded by said forward casing and said separating plate; and wherein said reverse rotating member, said reverse pair of pistons and said reverse piston directing means constitute a reverse hydraulic motor formed within a structure surrounded by said reverse casing and said separating plate.

24. The invention according to claim 23:

wherein each of said forward and reverse rotating members are circular and have a given radius; and wherein each of said forward and reverse casings include a ring structure, positioned around an associated one of said rotating members, each ring structure having an arc surface of an inner radius greater than said given radius around with it is concentrically positioned, said forward and reverse casings each further including an end plate affixed to said ring structure, whereby said forward chamber is formed in said forward hydraulic motor between said forward casing end plate and ring structure inner surface, said separating plate and said forward rotating members and said reverse chamber is formed in said reverse hydraulic motor between said reverse casing end plate and ring structure inner surface, said separating plate and said reverse rotating members; and wherein said forward piston directing means extends from said forward casing ring inner surfaces to said forward rotating member and is in sealed contact with said separating plate, said end plate of said forward casing and said forward rotating member and said reverse piston directing means extends from said reverse casing ring inner surfaces to said reverse rotating member and is in sealed contact with said separating plate, said end plate of said reverse casing and said reverse rotating member.

25. The invention according to claim 24 wherein both said forward and reverse piston directing means include a smooth curving surface on both sides thereof from said ring structure to said rotating member.

26. The invention according to claim 24 wherein said pistons each include spring means positioned therefrom towards said interior side of said slot in which said piston is movable, said spring means being biased away from said interior side of said slot.

27. The invention according to claim 24 wherein said end plates each includes a semicircular channel formed in the side thereof facing a rotating member, said semicircular channel extending rotationally from the side, in the direction of rotation, of said associated piston directing means over the path followed by the space between the back of one of said slots and the interior surface of one of said pistons, said fluid providing means being selectively coupled in fluid communication with said channels in response to said desired direction of rotation of said shaft.

28. The invention according to claim 27 wherein said end plates and said separating plate include said means for removing fluid path as a pair of second channels, each second channel being associated with a different one of said rotating members and associated piston directing means, each second channel being formed in the side of such plate facing a rotating member and each second channel extending from the side, opposite to the direction of rotation of said associated rotating member, of said associated piston directing means to a position aligned with the space between the back of a slot and the interior surface of a piston positioned in said slot, at the rotational position when said piston is directed into said slot by said associated directing means, said fluid providing means being coupled in fluid communication with said second channels as a return path.

29. The invention according to claim 28 wherein a pair of second channels are positioned in one of said end plates or said separating plate, each in fluid communication as a return path with said fluid providing means, one of said second channels being positioned from the intersection of the reverse direction side of said forward piston directing means and said forward chamber and extends to a position above the interior side of a slot when said piston is first fully directed into said slot during each forward direction revolution and the other of said second channels being positioned from the intersection of the forward direction side of said reverse piston directing means and said reverse chamber and extends to a position above the interior side of a slot when said piston is first fully directed into said slot during each reverse direction revolution.

30. The invention according to claim 29 wherein a pair of third channels are positioned in one of said end plates or said separating plate, each third channel being in selective fluid communication, one at a time as a return path, with said fluid providing means, one of said third channels being positioned from the intersection of the forward direction side of said forward piston directing means and said forward chammber and extends to a position above the interior side of a slot when said piston is first fully directed into said slot during each reverse direction revolution and the other of said third channels being positioned from the intersection of the reverse direction side of said reverse piston directing means and said reverse chamber and extends to a position above the interior side of a slot when said piston is first fully directed into said slot during each forward direction revolution.

31. The invention according to claim 30 wherein said fluid providing means includes valve means for coupling to said fluid providing means said second channel as a return path, for selectively coupling said first channel of said forward motor, as a pressure path, and said third channel of said reverse motor, as a return path, during desired forward direction operation of said hydraulic motor, and for selectively coupling said first channel of said reverse motor, as a pressure path, and said third channel of said forward motor, as a return path, during desired reverse direction operation of said hydraulic motor.

32. The invention according to claim 1, wherein said fluid path of each piston is directed to permit fluid to flow into said chamber in a direction opposite to the rotation of said rotating member.

33. The invention according to claim 14, wherein said fluid path of each piston is directed to permit fluid to flow into said chamber in a direction opposite to the rotation of said rotating member.

34. The invention according to claim 22, wherein said fluid path of each piston is directed to permit fluid to flow into said chamber in a direction opposite to the rotation of said rotating member.

35. The invention according to claim 1 wherein said fluid path included in said return path further bridges the space from said outlet to the end of said means to direct in the direction of rotation of said rotating member.

* * * * *